US005694881A

United States Patent [19]

Creech

[11] Patent Number: 5,694,881

[45] Date of Patent: Dec. 9, 1997

[54] PORTABLE VISUAL DISPLAY ASSEMBLY

[75] Inventor: Eugene Creech, Reno, Nev.

[73] Assignee: Eagle Scoreboard Systems, Sparks, Nev.

[21] Appl. No.: 536,386

[22] Filed: Sep. 29, 1995

[51] Int. Cl.[6] ..... A63F 9/00

[52] U.S. Cl. ..... 116/222; 40/605; 40/606

[58] Field of Search ..... 40/489, 605, 606; 116/222, 223, 224, 225, 63 P; 273/DIG. 26

[56] References Cited

U.S. PATENT DOCUMENTS

| | | | |
|---|---|---|---|
| 16,868 | 2/1857 | Anderson | 40/606 |
| 614,432 | 11/1898 | Austin . | |
| 1,010,379 | 11/1911 | King | 40/606 X |
| 1,167,715 | 1/1916 | Preo . | |
| 1,472,928 | 11/1923 | MacKenzie | 40/489 |
| 1,756,389 | 4/1930 | Schneider | 40/606 X |
| 2,643,466 | 6/1953 | Bucher | 116/222 X |
| 2,865,124 | 12/1958 | Mortellito | 40/605 |
| 3,468,039 | 9/1969 | Dubbert . | |
| 3,659,365 | 5/1972 | Eaton | 40/611 |
| 3,726,535 | 4/1973 | Longato | 280/659 |
| 4,367,000 | 1/1983 | Sparks et al. | 40/605 X |
| 4,684,099 | 8/1987 | Krapf | 248/447.1 |
| 5,090,735 | 2/1992 | Meaney et al. | 273/DIG. 26 X |
| 5,251,570 | 10/1993 | Creech | 116/225 |

*Primary Examiner*—William A. Cuchlinski, Jr.
*Assistant Examiner*—Willie Morris Worth
*Attorney, Agent, or Firm*—Dowell & Dowell

[57] ABSTRACT

A portable visual display assembly comprises modular sections selectively configurable between a combined full-size display board configuration and a separated plural smaller single display board configuration. The display boards can have identical or different grids permanently displayed on their front and back faces. The assembly includes wheels which are removable in both configurations. The display boards can be propped open to a selected angle. The visual display assembly is particularly suitable for use as a scoreboard for sporting event tournament play, such as for golf events, with the full-size configuration being advantageous for tournaments having a large number of participants.

19 Claims, 4 Drawing Sheets

PORTABLE VISUAL DISPLAY ASSEMBLY

BACKGROUND OF THE INVENTION

1. Field of the Invention

This invention is generally directed to display structures, and, more particularly, to a full-size portable display board assembly which can be quickly and easily separated into smaller portable display board structures. The display board assembly has utility in numerous applications, and is particularly suitable for use in portable scoreboards for sporting events.

2. History of the Related Art

Devices for displaying printed and other visual media such as advertising information are well known as exemplified in U.S. Pat. No. 614,432 to Austin and U.S. Re-Issue Pat. No. 16,868 to Anderson.

Also known are display boards for keeping track of the scores of various games and sporting events such as disclosed in U.S. Pat. No. 1,167,715 to Preo.

A recent development in display boards, disclosed in U.S. Pat. No. 5,251,570 to the present inventor, is a multi-purpose scoreboard system suitable for use in games such as golf, tennis and trap and skeet shooting events, and includes a plurality of scoreboard panels which are portable so as to be selectively movable between an outdoor support system and an indoor support system.

While the known scoreboard devices are presently popular, particularly for use in golf tournaments, there has been a need for a portable display assembly having means for recording and updating the scores of a large number of players for large tournaments, and which is readily separable into smaller display board structures for keeping track of the scores of a smaller number of players in smaller tournaments.

In view of the limitations and deficiencies associated with the known visual display board structures, and particularly those intended for use as scoreboards during game tournaments, there has been a need for a new portable display board structure which is advantageous for use in both large and small tournaments.

SUMMARY OF THE INVENTION

The present invention has been made in view of the above described and other limitations and deficiencies of the known devices, and has as an object to provide a visual display assembly which provides a visual display module including an attachment means for readily locking together with one or more other visual display modules to form a unitary large visual display board structure.

It is another object of the present invention to provide a visual display assembly particularly suitable for use as a scoreboard in both large and small game tournaments.

It is a further object of the present invention to provide a visual display assembly having display panels which may be propped open at a selected angle to provide enhanced visibility to persons at different positions.

It is yet another object of the present invention to provide a portable visual display assembly having easily removable supporting wheels, and which can be separated into smaller sized visual display boards, each having easily removable wheels.

It is another object of the present invention to provide a visual display assembly having visual display boards which have the same or different grid designs printed on their opposed front and back sides.

It is even another object of the present invention to provide a visual display assembly which is separable into smaller visual display board systems.

The above and other additional objects and advantages of the present invention will become apparent from the detailed description which follows, considered in conjunction with the accompanying drawing figures.

To achieve the objects of the invention as broadly described herein, the visual display assembly in accordance with a preferred embodiment of the invention is suitable for a range of uses, and particularly as a scoreboard for golf and other sporting tournaments. The display assembly is selectively configurable between a single full-size visual display board configuration and a plural smaller size visual display board modules configuration. Preferably two visual display board modules are utilized, each having identical or different grids permanently displayed on both their front and back sides. The full-size display board configuration is preferred for larger tournaments and the plural smaller size display board configuration for smaller tournaments. The display assembly is portable and includes wheels, removable in both configurations, which have brakes.

DETAILED DESCRIPTION OF THE PREFERRED EMBODIMENT

Figure 1:
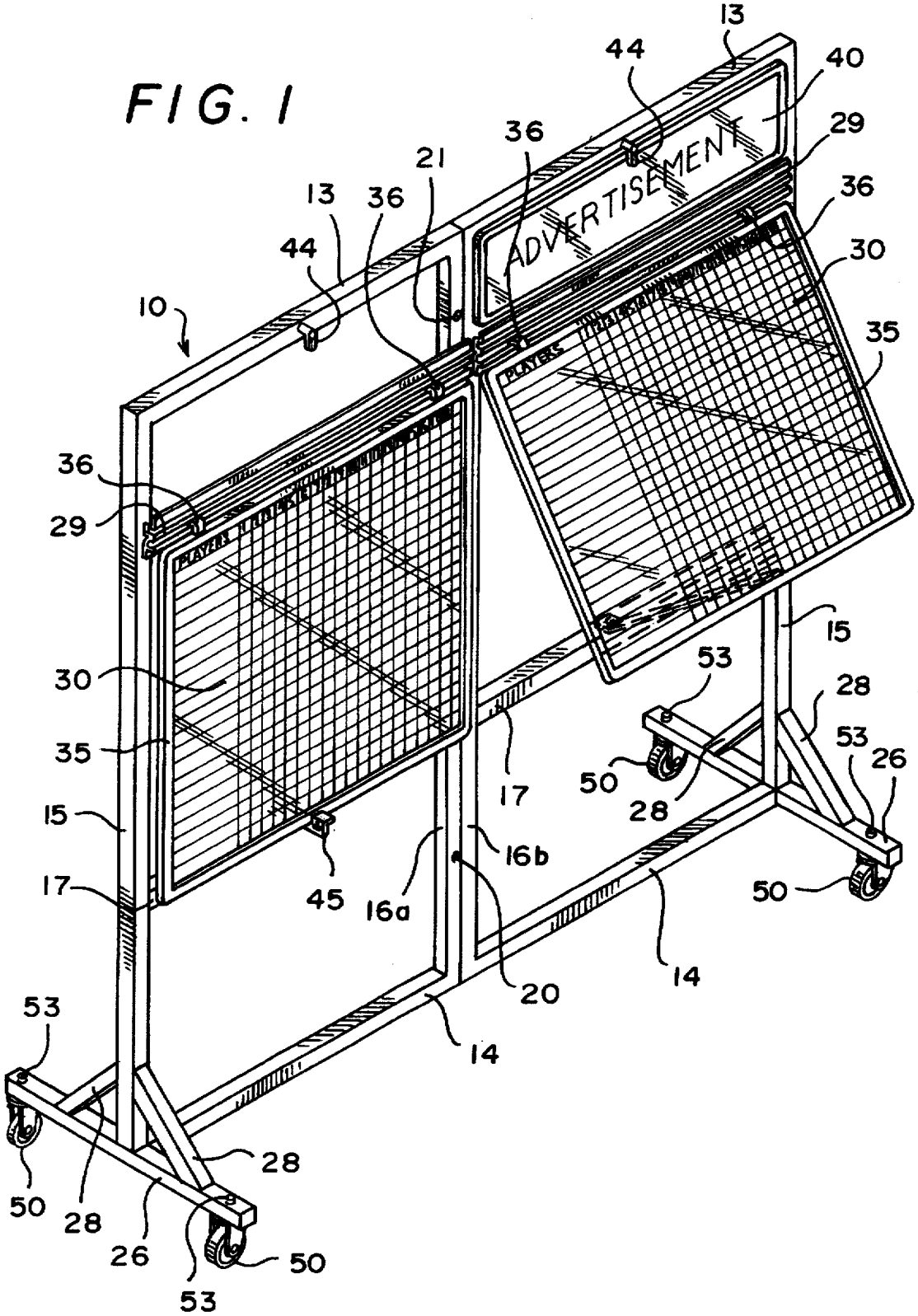
FIG. 1 is a front perspective view of a portable visual display assembly in accordance with a preferred embodiment of the present invention shown in a full size, side-by-side configuration.

With reference to the drawings, FIGS. 1 through 6 illustrate a preferred embodiment of a portable visual display assembly in accordance with the present invention. The illustrated assembly is configurable between a first, double-size visual display board configuration as particularly shown in FIG. 1, and a second configuration providing a pair of separate, half-size visual display boards, as particularly shown in FIG. 6. The first configuration double-size visual display board assembly 10 is shown in FIG. 1.

It will be understood by those skilled in the art that the display board assembly in accordance with the present invention may be comprised of more than the two display modules illustrated in FIG. 1. For example, the assembly may include a series of three or more attachable display board modules (not shown) to provide additional display space. Furthermore, while it is preferred that each of the sections be of substantially the same size, alternatively, in any of the embodiments, the sections can be of different sizes.

Figure 2:
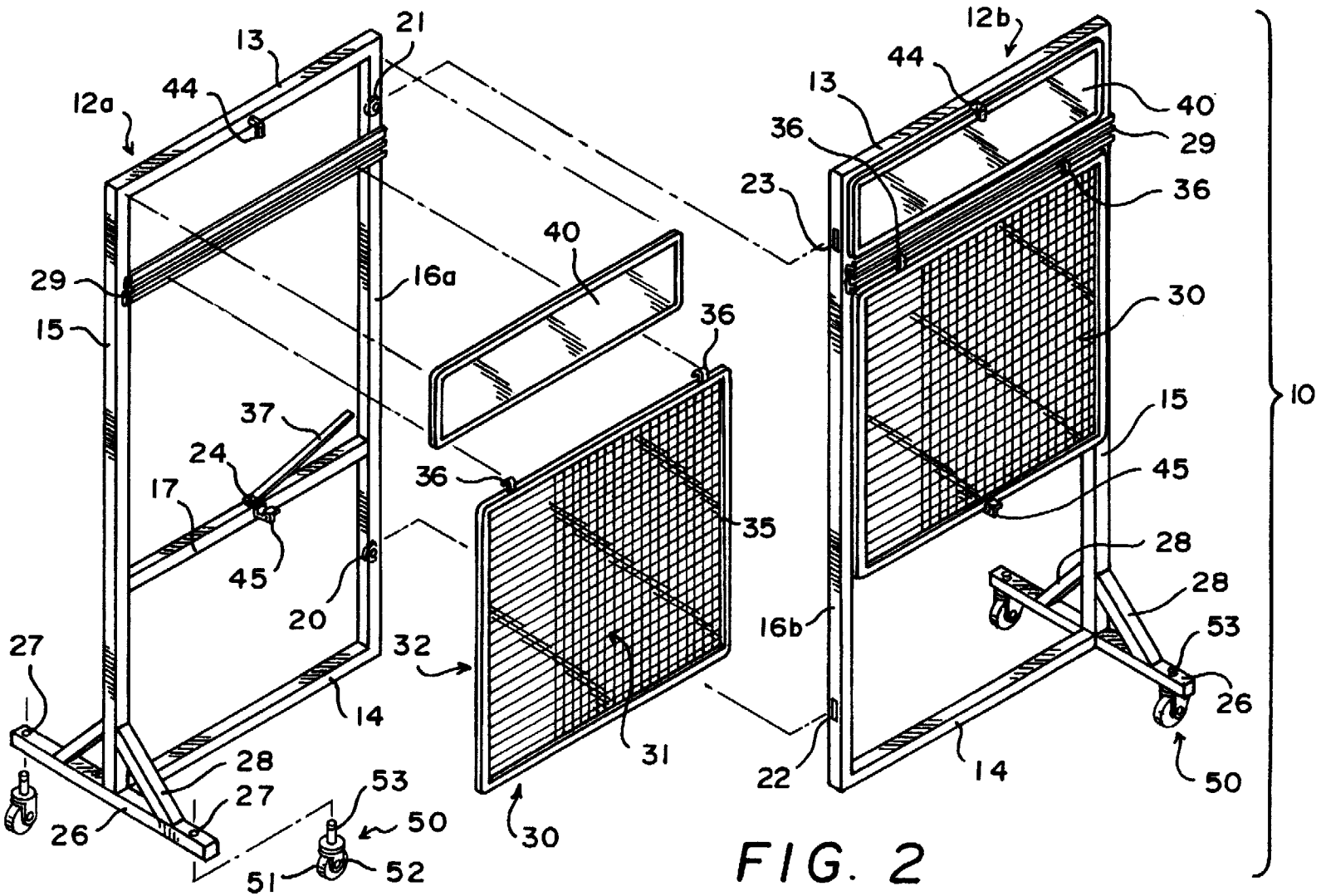
FIG. 2 is an exploded front perspective view of the portable visual display assembly of FIG. 1.

As best seen in the exploded view of FIG. 2, the portable visual display board assembly 10 is comprised of a pair of half-size visual display board sections or modules; namely first visual display board section or module 12a and second visual display board section or module 12b. Each of these visual display board sections 12a and 12b includes a top horizontal frame bar 13 and a bottom horizontal frame bar 14, an outer vertical frame bar 15 and a horizontal crossbar 17. First visual display board section 12a has an inside vertical frame bar 16a, and the second visual display board section 12b has an inside vertical frame bar 16b. Each of the frame bars for each individual module comprise part of a unitary structure. The inside vertical frame bar 16a in the visual display board section 12a has a lower rotary locking mechanism 20 and an upper rotary locking mechanism 21. The inside vertical frame bar 16b in the visual display board section 12b has a lower slot 22 for lockingly receiving the lower rotary locking mechanism 20 and an upper slot 23 for lockingly receiving the upper rotary locking mechanism 21. While the mating rotary locking mechanisms are the preferred means for attachment of the modules, other suitable attachment means may be alternately used.

Figure 5:
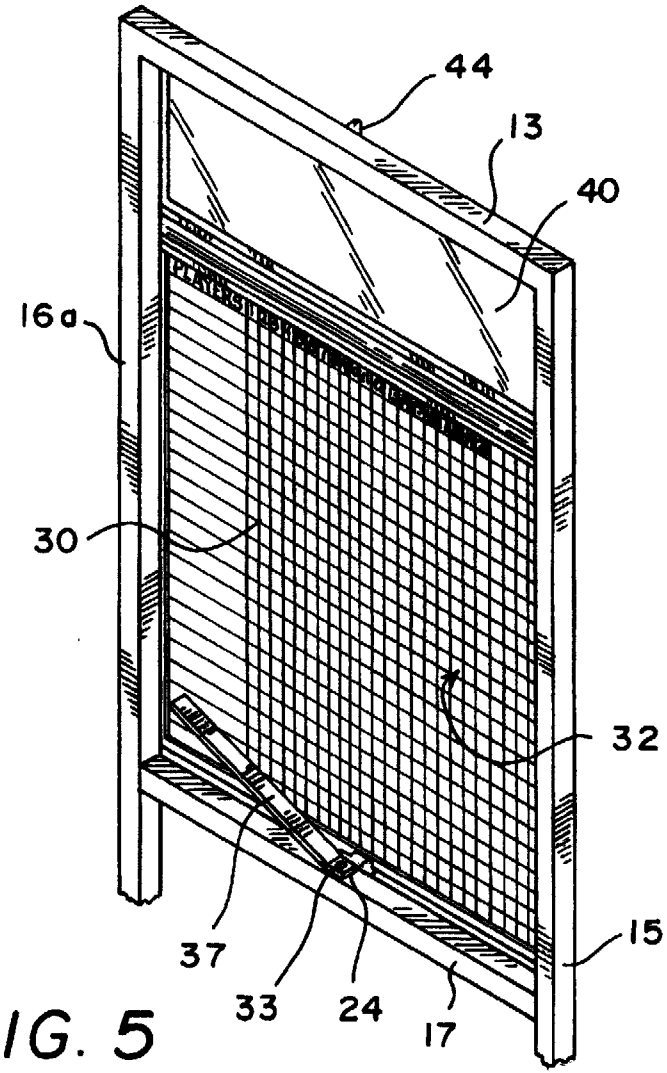
FIG. 5 is a partial rear perspective view of a portion of a portable visual display assembly in accordance with a preferred embodiment of the present invention shown in a single display board configuration.

A prop screw 33, best seen in FIG. 5, is preferably located centrally in the horizontal crossbar 17 of each of the visual display board sections 12a and 12b for mounting a pivoting prop 37 near the prop's end 24. The prop 17 is preferably a flat aluminum bar bent at a slight angle, preferably about 10 degrees with respect to the horizontal, with the end section 24 parallel to and pivotably attached to the crossbar 17.

Mounted at the bottom of each of the outside vertical frame bars 15 is a horizontal wheel support bar 26, defining wheel support bores 27 at opposed ends. A pair of inclined wheel support bars 28 are provided to support the frame bar 15 relative to the support bar 26.

Visual display board support track sections 29 are suspended between the outside vertical frame bar 15 and the inside vertical frame bar 16a, and the outside vertical frame bar 15 and the inside vertical frame bar 16b.

A visual display means is suspendable from each visual display board support track section 29. The visual display means is preferably a panel or board 30 having hanging hooks 36. In the illustrated preferred embodiment, a two-sided scoreboard is formed by providing a first score grid 31 on the front face of the visual display panel 30 and a second score grid 32 on the rear face of the visual display panel 30. The first and second score grids 31 and 32 can be substantially identical to or alternatively different from each other. A visual display board frame 35 is formed around the scoreboard 30. The score grids 31 and 32 on scoreboard 30 are preferably written upon using dry erasable type pens or the like. Other suitable alternative means for providing letters and numbers on the board may be used, such as providing on the faces of the board a material suitable for use with magnetic numbers and letters. Also, while it is preferred that the visual display means be comprised of grids printed on a panel or board constructed from a relatively rigid material, any suitable alternative visual display means may be used as part of the invention. For example, a non-rigid sheet-like material may be used instead of the rigid board.

A pivoting wind clip 45 may be utilized to prevent each of the display boards 30 from flapping in the wind.

Figure 4:
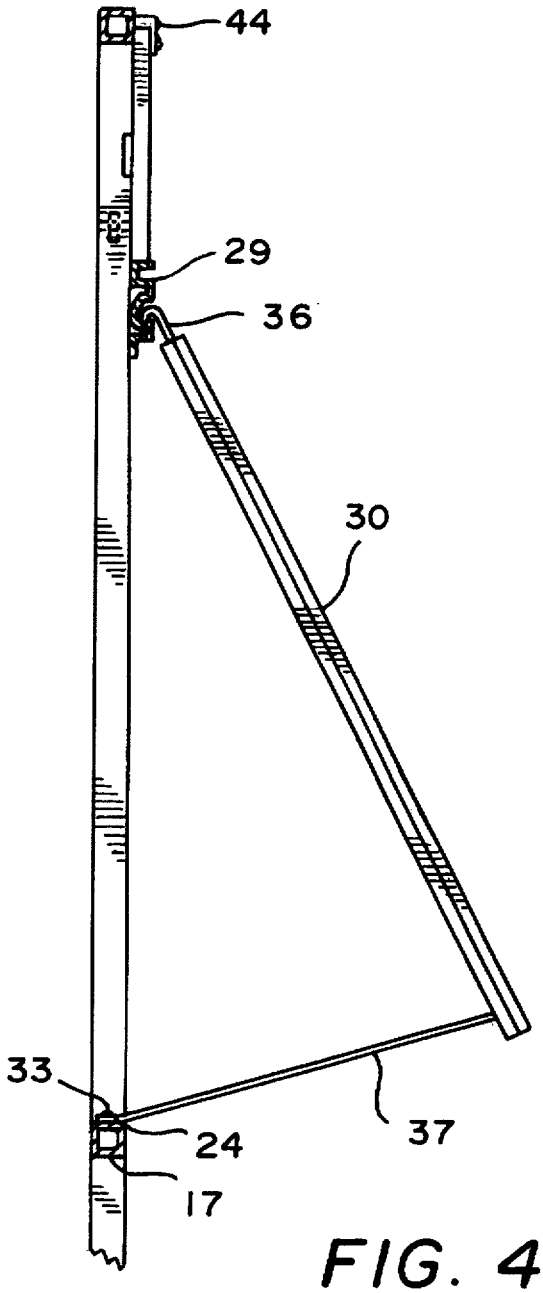
FIG. 4 is a partial side elevational cross-sectional view of the portable visual display assembly of FIG. 1.

As shown in FIG. 4, the prop 37 can be used to prop the scoreboard 30 up at an angle to change the viewing angle.

An optional advertising sign 40 for product and other information can be mounted at the top portion of each of the visual display board sections 12a and 12b, using any suitable mounting means, such as the sign clip 44 as shown in FIG. 5. The sign clip 44 is adapted to pivot around into a position for holding the sign firmly and around into a position from which the sign can be removed.

The display board assembly 10 is movably supported by a plurality of detachable wheel or castor assemblies 50. Each wheel assembly 50 includes a wheel 51 positioned within a wheel support 52 and a pivot pin 53, which is removably inserted within the wheel support bores 27 of the support base 26 to attach the wheel assembly. Four wheels 51 are used when the portable visual display board structure 10 is configured in the full-size arrangement as shown in FIG. 1. Alternatively, the wheel assemblies 50 may be removed so that the horizontal wheel support bars 26 lie flat against the ground, as do the bottom horizontal frame bars, providing stable support for the visual display board structure 10.

When the visual display board assembly 10 is configured into two individual visual display boards utilizing the first visual display board section 12a and the second visual display board section 12b as shown (in FIG. 6 for second visual display board section 12a), two of the wheel assemblies 50 of the assembly of FIG. 1 are mounted in the wheel support bores 27 of each display board section, and a third wheel assembly 54 having a pivot pin 55 extending therefrom is positioned within a bore 57 defined within each of the inside vertical frame bars 16a and 16b.

Figure 6:
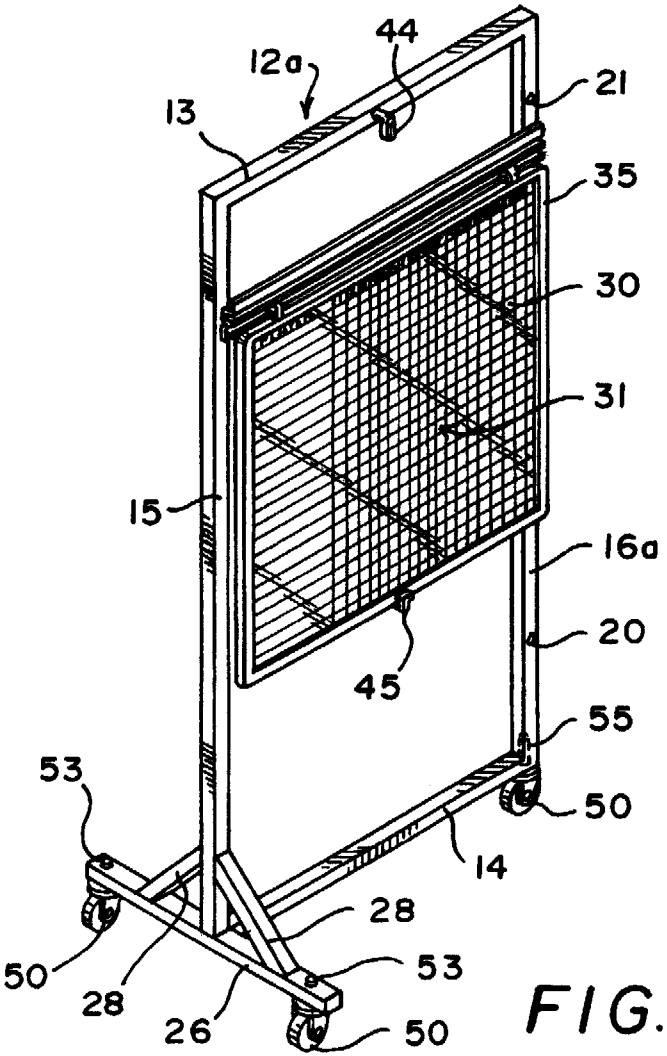
FIG. 6 is a front perspective view of a portable visual display assembly in accordance with a preferred embodiment of the present invention shown in a smaller size single visual display board configuration.

The portable visual display board assembly 10 of the present invention is very easy to use and can be quickly configured between the full-size visual display board configuration as shown in FIG. 1 and the half-size configuration as shown in FIG. 6. In both configurations, the display boards may be utilized with or without wheels. The full-size visual display board 10 of FIG. 1 can be quickly detached into individual visual display board sections as illustrated in FIG. 6. The sections 12a and 12b are detached from each other by turning each of the lower and upper rotary locking mechanisms 20 and 21, respectively, in framebar 16a, and separating the framebar 16a from the framebar 16b. When turned, the upper and lower rotary locking mechanisms 20 and 21 slip out of the upper and lower slots 22 and 23, respectively, and the two sections 12a and 12b separate. After separation, the sections are used as two separate display boards or, alternatively, only one of the sections may be used. Each of the sections 12a or 12b can be utilized with three wheels as a tricycle type visual display board as shown in FIG. 6, or alternatively without wheels and laying flat on a support surface with bottom horizontal framebar 14 and horizontal wheel support 26 securely positioned against the surface.

While it is preferred to have substantially the same grid on both the back face 32 and the front face 31 of the visual display board 30, in alternative embodiments, different information can be printed on the respective sides 31 and 32.

Reattaching the two visual display board sections 12a and 12b is also easy. Particularly, the inside support bars 16a and 16b are aligned adjacent one another and the rotary locks 20 and 21 are positioned within support slots 22 and 23. The rotary locks 20 and 21 are then turned until they are locked into position within the slots 22 and 23 respectively.

Scores can be written on the front and/or the back sides of the display and the scores on the back are visible simply by walking around, or, alternatively, by turning the structure around.

At times when the assembly is located on a surface such that the display is lower than the intended viewers, it may be beneficial to provide a better viewing angle by propping the display upward at an angle relative to the plane of the frame of the assembly. As shown in FIG. 5, a prop 37, preferably a flat ⅛" aluminum bar, approximately 20" long and bent approximately 10 degrees about 1 inch from a first end is utilized. The prop 37 is drilled and screwed to the center of horizontal bar 17. The opposite end rests against the bottom frame of the scoreboard when pivoted outward. When not in use, the bar swings 90 degrees left or right to be stored out of the way until next needed. Alternatively, the prop may be an elongated metal or plastic rod or bar, or a telescoping prop, for enabling the prop angle to be selectively increased or decreased as desired.

Figure 3:
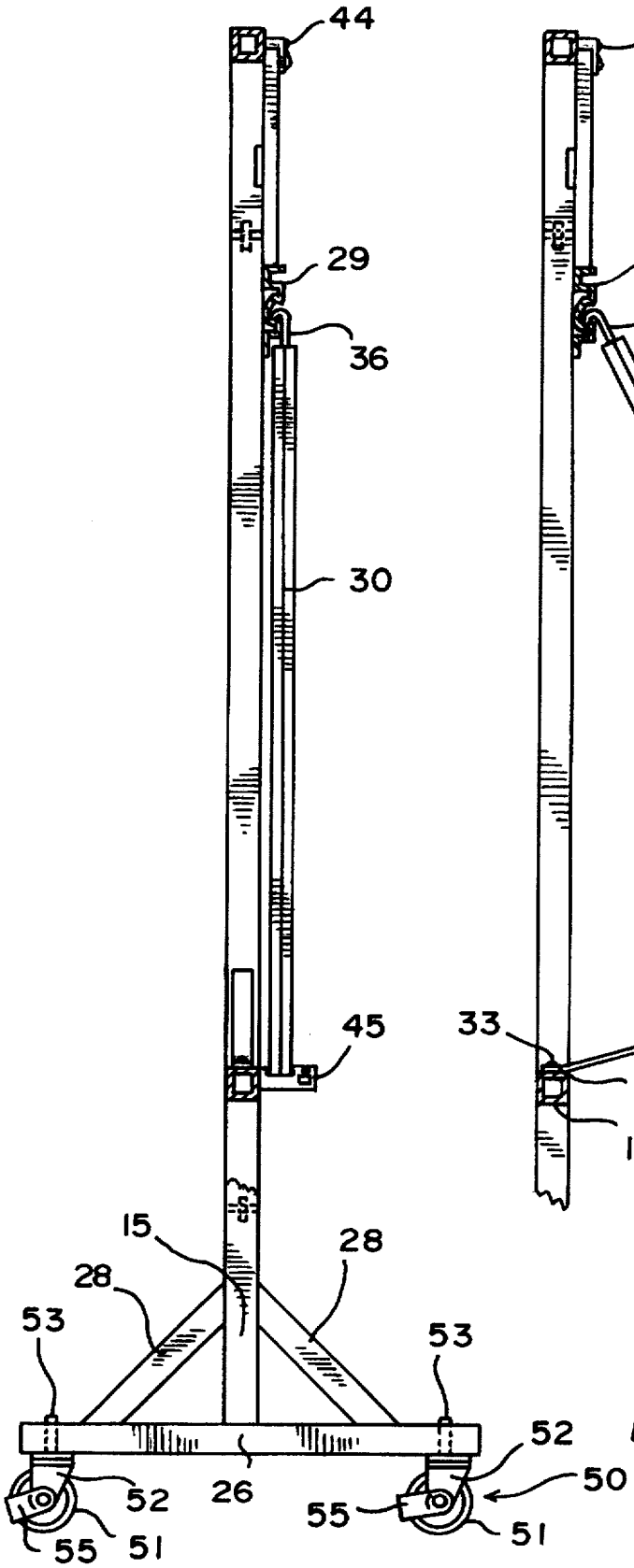
FIG. 3 is a side elevational view partially in cross-section of the portable visual display assembly of FIG. 1.

Each of the wheels are preferably composed of a hard rubber material and are preferably approximately five inches high by one and one-eighth inches wide, so as to be capable of supporting preferably at least 200 lbs. each. The wheels preferably have ball bearings and are capable of swiveling 360 degrees. As shown in FIG. 3, each wheel preferably includes a brake 55 which can be activated to prevent the visual display assembly from rolling around.

Each visual display board section 12*a* and 12*b* is preferably approximately four foot wide by eight foot high such that when locked together by the rotary locks, a single eight foot by eight foot structure is created. In a most preferred embodiment, each section is about 50 inches wide and about 90 inches high.

The visual display board assembly in accordance with the present invention is suitable for use in a variety of indoor and outdoor applications in which a portable display is desired. The assembly is particularly suitable for use as a scoreboard for various sporting events, including golf, trap and skeet shooting, darts, shuffleboard, skiing, handball, baseball, and racquetball. It will be understood that the assembly may also be used in applications such as at trade shows, cafeterias, schools, offices, and the like to display information. For example, the assembly may be used as a chalkboard in a school setting.

The portable visual display board assembly may be used outside on grass or other surfaces and then easily moved indoors when the wheels are attached. When the wheels are removed, the structure securely rests flat on the floor or ground.

The foregoing description of the preferred embodiments of the invention has been presented to illustrate the principles of the invention and not to limit the invention to the particular embodiments illustrated. It is intended that the scope of the invention be defined by all of the embodiments encompassed within the following claims.

I claim:

1. A portable display assembly comprising: a first display module including a first frame and a first display panel and having a first support means for supporting said first display panel on said first frame, and a second display module including a second frame and a second display panel and having a second support means for supporting said second display panel on said second frame;

each of said first and second frames including first and second spaced vertically extending end members, a plurality of wheel assemblies, said first and second display modules including support members for attaching said plurality of wheel assemblies thereto to movably support said first and second display modules, attaching means for attaching said second vertically extending end members to each other to form a combined display configuration, and said first and second display modules being detachable from each other to form separate configurations in which said first and second display modules each provide separate portable displays.

2. The portable display assembly of claim 1 wherein said wheel assemblies are removably mounted to said support members of said first and second display modules.

3. The portable display structure of claim 1 wherein said first display panel is a first scoreboard and said second display panel is a second scoreboard.

4. The portable display assembly of claim 3 wherein said first and second scoreboards each have a front face on which is provided a first score grid, and a back face on which is provided a second score grid.

5. The portable display assembly of claim 4 wherein said first and second score grids are substantially identical patterns.

6. The portable display assembly of claim 1 wherein said first and second display modules are substantially the same size.

7. The portable display assembly of claim 1 wherein each of said frames of said first and second display modules include a top horizontal frame member, a bottom horizontal frame member and a cross member each extending between said first and second vertically extending end members.

8. The portable display assembly of claim 7 further comprising a first means for maintaining said first display panel at a selected angle relative to a plane defined by said first frame, and a second means for maintaining said second display panel at a selected angle relative to a plane defined by said second frame.

9. The portable display assembly of claim 8 wherein each of the first and second means for maintaining is an elongated prop.

10. The portable display assembly of claim 7 wherein said first and second support means each include a support track section mounted to said first and second frames in a horizontal orientation.

11. The portable display assembly of claim 1 wherein in said combined display configuration said support members for attaching said plurality of wheel assemblies are provided at spaced locations adjacent said first vertically extending end members of said first and second frames.

12. The portable display assembly of claim 1 wherein said wheel assemblies of each of said first and second display modules includes a pair of wheel assemblies mounted at a first location and another wheel assembly mounted at a second location spaced from said first location when said modules are in said separate configurations.

13. The portable display assembly of claim 12 wherein each of said support members for attaching wheel assemblies of each of said first and second display modules extends horizontally and transversely with respect to said first and second frames and are adapted to support the display assembly when the wheel assemblies are removed therefrom.

14. The portable display assembly of claim 7 wherein said attaching means includes a lower rotary locking mechanism and an upper rotary locking mechanism mounted on one of said first and second frames.

15. The portable display assembly of claim 1 wherein said first frame of said first display module includes means for supporting a third display panel above said first display panel and wherein said second frame of said second display module includes means for supporting a fourth display panel above said second display panel.

16. The portable display assembly of claim 15 wherein said third and fourth display panels are signs.

17. A scoreboard system having a first configuration suitable for use in tournaments having a large field of competitors and a second configuration suitable for use in tournaments having a smaller number of competitors, comprising:

a first score display module including a first frame having opposite ends and upper and lower portions a first score display panel, and first means for supporting said first score display panel on said first frame;

a second score display module including a second frame having opposite ends and upper and lower portions, a second score display panel, and second means for supporting said second score display panel on said second frame;

means for attaching said first and second frame to each other in end to end relationship to form a combined first configuration, and said first and second frames being selectively detachable from each other to form separate first and second display module configurations in which said first and second score display modules are useable independently of one another; a plurality of wheel assemblies and said first and second score display modules including support members for attaching said plurality of wheel assemblies to thereby movably support said first and second score display modules.

18. The portable scoreboard assembly of claim 17 wherein each of said first and second frames include a top horizontal frame member, a bottom horizontal frame member, an outside vertical frame member and an inside vertical frame member each extending between said top horizontal frame member and said bottom horizontal frame member, and a horizontal cross member mounted between said outside vertical frame member and said inside vertical frame member, and a prop mounted to each of said first and second frames to maintain said first and second score display panels at an angle relative to a plane defined by said first and second frames.

19. The scoreboard system of claim 17 wherein a pair of said wheel assemblies is mounted to said support members adjacent one end of each of said first and second frames of first and second score display modules and another wheel assembly mounted to each of said first and second frames adjacent the opposite ends of said first and second frames.

* * * * *